US010614979B2

(12) United States Patent
Zhang et al.

(10) Patent No.: US 10,614,979 B2
(45) Date of Patent: Apr. 7, 2020

(54) ARC CHUTE WITH SPLITTER PLATES INTERCONNECTED BY RESISTORS

(71) Applicant: ABB Schweiz AG, Baden (CH)

(72) Inventors: Zichi Zhang, Västerås (SE); Stefan Valdemarsson, Lidköping (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/477,107

(22) PCT Filed: Jan. 13, 2017

(86) PCT No.: PCT/EP2017/050670
§ 371 (c)(1),
(2) Date: Jul. 10, 2019

(87) PCT Pub. No.: WO2018/130296
PCT Pub. Date: Jul. 19, 2018

(65) Prior Publication Data

US 2019/0355533 A1 Nov. 21, 2019

(51) Int. Cl.
*H01H 33/08* (2006.01)
*H01H 33/60* (2006.01)

(52) U.S. Cl.
CPC ..... *H01H 33/08* (2013.01); *H01H 33/60* (2013.01)

(58) Field of Classification Search
CPC ..... H01H 33/08; H01H 33/59; H01H 33/04; H01H 33/60; H01H 2033/085; H01H 9/36; H01H 9/34; H01H 9/346; H01H 9/345; H01H 9/542; H01H 2009/543; H01H 9/42
USPC .... 218/48, 30, 34, 38, 46, 81, 102, 105, 110
See application file for complete search history.

(56) References Cited

U.S. PATENT DOCUMENTS 1,819,207 A 8/1931 Slepian
2,208,399 A 7/1940 Slepian
4,401,863 A * 8/1983 Lemmer ..... H01H 50/546 200/16 A (Continued)

FOREIGN PATENT DOCUMENTS

DE 1182323 B 11/1964
DE 19810981 A1 9/1999

(Continued)

OTHER PUBLICATIONS

International Preliminary Report on Patentability Application No. PCT/EP2017/050670 Completed: Feb. 15, 2019; dated Feb. 15, 2019 12 pages.

(Continued)

*Primary Examiner* — William A Bolton
(74) *Attorney, Agent, or Firm* — Whitmyer IP Group LLC

(57) ABSTRACT

A switchgear includes a circuit breaking section having a moveable contact bridging element and at least one first arc chutes adjacent the contact bridging element, each arc chute including a base plate for connecting to the contact bridging element and a group of splitter plates placed adjacent the base plate, where the splitter plates of the groups are separated from the base plate and each other via air gaps and resistors interconnect at least some of the plates in at least a first of the arc chutes for bypassing corresponding air gaps, wherein the resistors have values in the range 5 kΩ-1 MΩ, current ratings below 100 mA and power ratings below 1 W.

18 Claims, 4 Drawing Sheets

(56) References Cited

U.S. PATENT DOCUMENTS

| | | | | |
|---|---|---|---|---|
| 7,285,742 | B2 * | 10/2007 | Kinzler | H01H 71/0207 218/149 |
| 7,551,050 | B2 * | 6/2009 | Annis | H01H 9/446 218/148 |
| 8,723,627 | B2 * | 5/2014 | Serpinet | H01H 71/56 335/131 |
| 9,484,168 | B2 * | 11/2016 | Pessina | H01H 33/04 |
| 2001/0015879 | A1 | 8/2001 | Benard et al. | |
| 2002/0134758 | A1 | 9/2002 | Duggal et al. | |

FOREIGN PATENT DOCUMENTS

| | | | |
|---|---|---|---|
| DE | 102013112400 | A1 | 6/2014 |
| GB | 1179736 | A | 1/1970 |
| GB | 2424766 | A | 10/2006 |
| WO | 02084688 | A1 | 10/2002 |
| WO | 2010037424 | A1 | 4/2010 |
| WO | 2016091318 | A1 | 6/2016 |

OTHER PUBLICATIONS

International Search Report and Written Opinion of the International Searching Authority Application No. PCT/EP2017/050670 Completed: Sep. 15, 2017; dated Oct. 11, 2017 15 pages.

* cited by examiner

ARC CHUTE WITH SPLITTER PLATES INTERCONNECTED BY RESISTORS

TECHNICAL FIELD

The present invention generally relates to switchgear in low voltage applications. More particularly the present invention relates to a switchgear with arc chutes.

BACKGROUND

Switchgear are provided in a number of different types of equipment in power transmission, distribution and supply systems, for instance in low voltage contactors.

It is known to provide switchgear with arc chutes comprising parallel splitter plates separated by air gaps in one or two groups on two sides of a moveable bridging element that interconnects two conductors. After the arc has been extinguished in the switchgear, a transient recovery voltage is applied across the parallel splitter plates.

Splitter plates are also known to be used for splitting an arc into partial arcs. This is as an example disclosed in WO 2016/091318. WO 2016/091318 also discloses the use of low ohmic resistors connected between the splitter plates for commutating circuit current into the resistors near the moment of current zero crossing. Thereby the air gap of the arc chute can cool down for a while and the dielectric strength may increase to improve the arc breaking performance.

There is one problem with a switchgear with arc chutes comprising parallel splitter plates and that is that a glow discharge may occur across one or more of the air gaps after the current interruption. The glow discharge may introduce more voltage stress across the other air gaps, which may in turn lead to an increase in the risk of arc re-ignition.

The present invention is directed towards the solving of the problem of glow discharges and the increased risk of arc re-ignition.

SUMMARY

One object of the present invention is to provide a switchgear that addresses the problem of glow discharges and the increased risk of arc re-ignition caused by them.

This object is according to the present invention obtained through a switchgear comprising a circuit breaking section having a moveable contact bridging element and at least one first arc chute adjacent the contact bridging element. Each arc chute comprises a base plate for connecting to the contact bridging element and a group of splitter plates placed adjacent the base plate. The splitter plates of the groups are separated from the base plate and each other via air gaps and resistors interconnect at least some of the plates in at least a first of the arc chutes for bypassing corresponding air gaps. The resistors have values in the range 5 kΩ-1 MΩ, current ratings below 100 mA and power ratings below 1 W.

The present invention has a number of advantages. It provides improved current breaking performance where arc re-ignition inside an arc chute can be greatly reduced. Due to the ratings used it is also possible to use low cost resistors, which means that the improved functionality is obtained with a minimum of additional expenses.

BRIEF DESCRIPTION OF THE DRAWINGS

The present invention will in the following be described with reference being made to the accompanying drawings, where FIG. 1 schematically shows a switchgear comprising a circuit breaking section in parallel with a current injecting section, FIG. 2 schematically shows a first embodiment of the circuit breaking section comprising a first and a second arc chute on opposite sides of a moveable contact bridging element, FIG. 3 schematically shows a second embodiment of the circuit breaking section, FIG. 4 schematically shows a third embodiment of the circuit breaking section.

DETAILED DESCRIPTION

The present invention concerns a switchgear, which may be provided in various types of electric equipment such as circuit breakers, contactors etc. The switchgear may more particularly be employed in low voltage applications in alternating current (AC) or direct current (DC) systems. In low voltage applications then for instance applications of 1000 V and above are contemplated, such as at 1200 or 1500 V.

Figure 1:
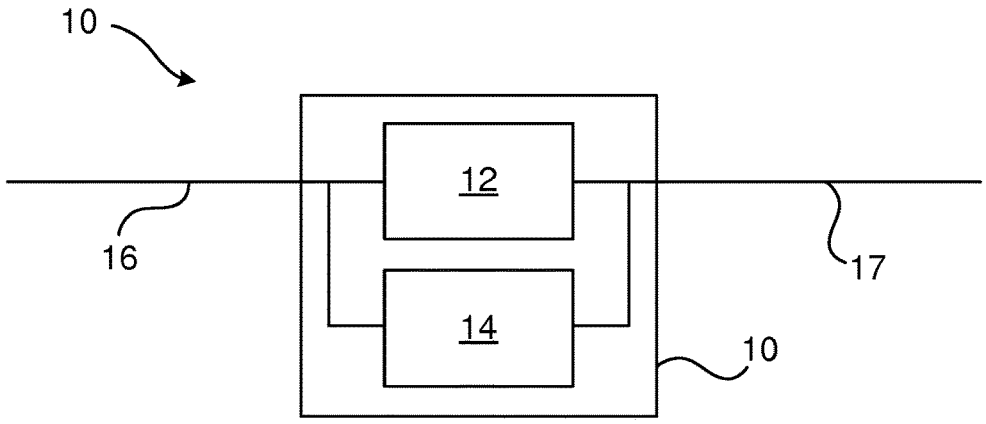

FIG. 1 schematically shows such a switchgear 10 connected between a first and a second conductor 16 and 17. The switchgear 10 comprises a first circuit breaking section 12 and optionally also a current injecting section 14. The first circuit breaking section 12 has two ends, each connected to a corresponding conductor 16 and 17. In parallel with the circuit breaking section 12 there is a current injecting section 14. The purpose of the current injecting section 14 is to inject a current with an opposite direction to a load current that runs in the conductors 16 and 17. Such a current injection may be needed in case of DC operation of the switchgear 10. In case of AC operation, the current injecting section 14 may be omitted.

In some variations of the invention a disconnector may be connected in series with the circuit breaking section 12. There may thus be an element provided that obtains a mechanical separation between conductors, which is however unable to extinguish any arcs at nominal current levels.

Figure 2:
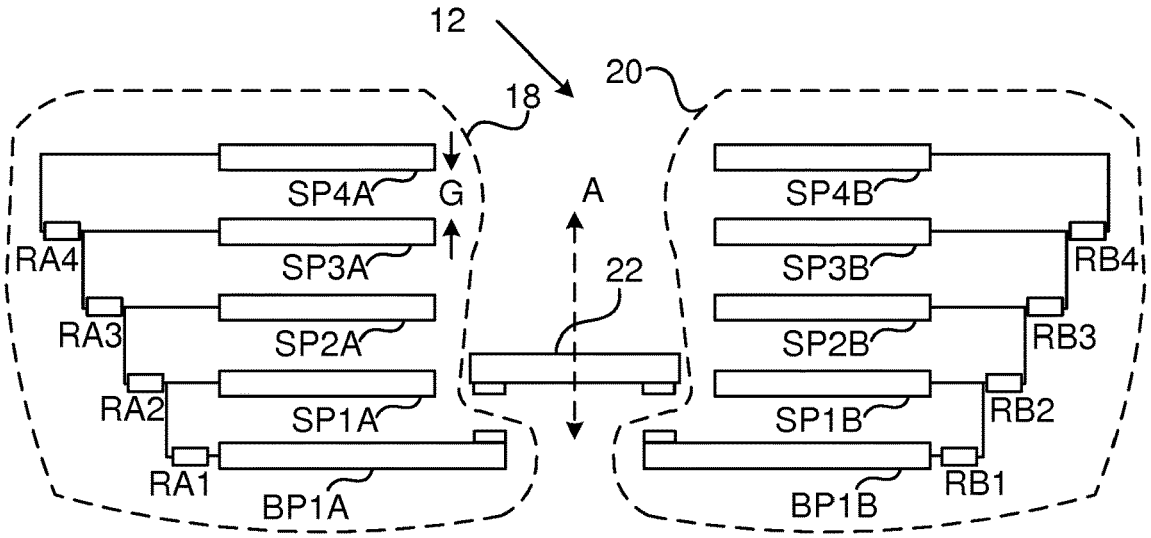

FIG. 2 schematically shows a side view of the circuit breaking section 12 according to a first embodiment.

The circuit breaking section 12 has a moveable contact bridging element 22 and at least one first arc chute adjacent the contact bridging element 22. In this first embodiment there is a pair of arc chutes 18 and 20 on each side of the contact bridging element 22. The two arc chutes 18 and 20 are thus provided on opposite sides of the contact bridging element 22. The first arc chute comprises a first group of splitter plates and a first base plate BP1A connected to the previously mentioned first conductor 16 (not shown). In the example given in FIG. 2 there are four splitter plates SP1A, SP2A, SP3A and SP4A in the first group. However, it should be realized that more or fewer splitter plates can also be used.

In a similar manner the second arc chute 20 comprises a second group of splitter plates and a second base plate BP1B connected to the previously mentioned second conductor 17

(not shown). In the example given in FIG. 2 there are four splitter plates SP1B, SP2B, SP3B and SP4B.

There is also a moveable contact bridging element 22 for interconnecting the first base plate BP1A with the second base plate BP1B. Each base plate BP1A, BP1B is thereby provided for connecting to the contact bridging element 22. The contact bridging element 22 is a mechanical bridging element and is furthermore moveable along a first axis A in order to make or break a galvanic contact between itself and the base plates BP1A and BP1B. The first axis A is vertical and essentially perpendicular to a common plane in which the two base plates BP1A, BP1B are provided. The contact bridging element 22 and base plates BP1A and BP1B are in this example provided with contact pads for obtaining galvanic contact between each other.

The splitter plates SP1A, SP2A, SP3, SP4A in the first group are placed adjacent the base plate BP1 and vertically stacked upon and separated from each other along a direction in parallel with the first axis of the contact bridging element 22. They are furthermore separated from each other and the base plate via air gaps G. In this first embodiment the air gaps G between neighboring plates are of equal size. All the air gaps in the arc chute between neighboring plates thus have the same widths. This means that the air gap between the first splitter plate SP1A and the base plate BP1A, the air gap between the second and first splitter plates SP1A and SP2A, the air gap between the third and second splitter plates SP3A and SP2A and the air gap between the fourth and the third splitter plates SP4A and SP3A have the same width. Furthermore there is a horizontal air gap between the splitter plates SP1A, SP2A, SP3A, SP4A and the contact bridging element 22 in order to ensure a galvanic separation between the contact bridging element 22 and the splitter plates as the contact bridging element 22 is moved up and down along the first axis when closing or opening the current path. Thereby it can be seen that the splitter plates SP1A, SP2A, SP3A, SP4A are smaller than the base plate BP1A at least in the horizontal direction.

The splitter plates SP1A, SP2A, SP3A, SP4A are of electrically conducting material, for instance aluminum or copper. Moreover, resistors interconnect at least some of the plates in at least the first of the arc chutes for bypassing corresponding air gaps. As can be seen in the first embodiment shown in FIG. 2 each air gap G of both air chutes 18 and 20 is being electrically bypassed by a resistor. Thereby all the plates in the arc chutes are interconnected by resistors.

Thereby the first splitter plate SP1A is electrically connected to the first base plate BP1 via a first resistor RA1, the second splitter plate SP2A is electrically connected to the first splitter plate SP1A via a second resistor RA2, the third splitter plate SP3A is electrically connected to the second splitter plate SP2A via a third resistor RA3 and the fourth splitter plate SP4A is electrically connected to the third splitter plate SP3A via a fourth resistor RA4. The resistors are here equal valued high ohmic resistors, for instance in the range 5 kΩ-1 MΩ and rated for low current and power levels below 100 mA and 1 W, such as being rated for 20 mA and 0.25 or 0.5 W.

In this embodiment of the circuit breaking section 12, the second arc chute 20 has the same configuration as the first arc chute 18. There are thus in this case also resistors RB1, RB2, RB3, and RB4 bridging the air gaps between the splitter plates and base plate in the same way as in the first arc chute 18 as well as horizontal and vertical air gaps between plates and contact bridging elements.

As can be seen in FIG. 2 all air gaps are thus bridged by high-ohmic resistors.

The resistors may be electronic resistors, because there is only very low current flowing through them. For example, in the application of 1500 Vdc rated voltage, each resistor may be 10 kΩ and if eight resistors are used as is shown in FIG. 2, there is only 19 mA of current through the resistors at the moment of current interruption.

Once the current in the circuit is interrupted, these high ohmic resistors keep the transient recovery voltage evenly distributed across all the air gaps of the arc chute. Thereby the uneven recovery voltage distribution is avoided and therefore the chance of arc re-ignition inside the arc chute would be reduced. Moreover, in case that a glow discharge occurs across one air gap, the voltage of this air gap reduces, discharging current increases and heats up the gap until the arc restrikes. When the high ohmic resistors are used, most part of the glow discharge current is commutated into the resistor, and thereby the effect of glow charge is mostly mitigated and consequently the risk of arc re-ignition is reduced.

In case there is any residual currents after the arc extinction, these may be easily interrupted by the opening of the optional disconnector.

Moreover, the resistor values are clearly too high for allowing any air gap cooling to take place.

The switchgear has a number of advantages. It has:

- improved current breaking performance: arc re-ignition inside arc chute can be greatly reduced, especially in the higher voltage applications, where conventional switchgear have difficulties to break the current;
- high ohmic resistor solutions barely add any cost to the switchgear. The board or the side wall where the resistors are placed is low in cost.

In the example in FIG. 2 all gaps between the arc chute elements were bridged by a resistor.

It is possible that one gap remains unbridged. One splitter plate may thus remain galvanically isolated from the other splitter plates.

Figure 3:
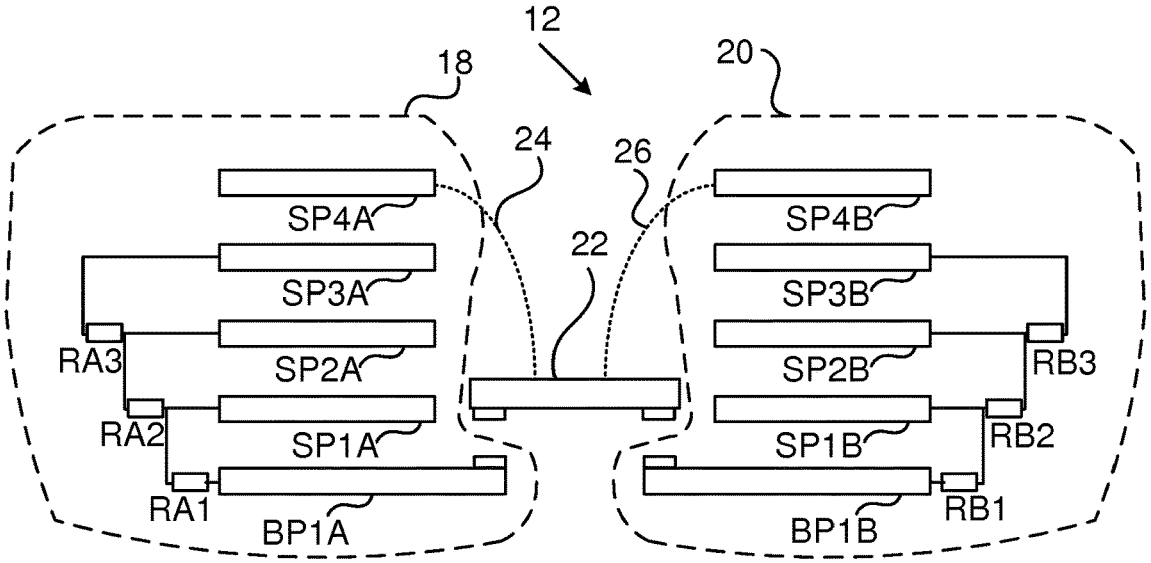

One example of this is shown in FIG. 3. In this case the uppermost splitter plate SP4A and SP4B of both the first and second arc chutes 18 and 20 is galvanically separated from the rest of the splitter plates of the group to which it belongs. Thereby all the plates in the first and second arc chutes 18 and 20 except for the uppermost splitter plates SP4A and SP44 are interconnected by resistors. There is thus no resistor connected between the uppermost splitter plate SP4A and SP4B and its closest neighbour SP3A and SP3B in a direction towards the base plate BP1A and BP1B. Moreover, these galvanically isolated splitter plates SP4A and SP4B are in this embodiment electrically connected to the contact bridging element 22. The moveable contact bridging element 22 is in fact electrically connected to the uppermost splitter plates SP4A, SP4B of both the first and second arc chutes 18, 20. The mechanical contact bridging element 22 thereby has a first electrical connection 24 to the first splitter plate SP4A of the first arc chute 18 and a second electrical connection 26 to the fourth splitter plate SP4B of the second arc chute 20.

In all other respects the second embodiment is similar to the first embodiment. Moreover, as one of the air gaps of each arc chute is kept resistor free, which in this case is the uppermost air gap, the galvanic insulation of the contactor is ensured for the moving contact bridging element. Furthermore, through the uppermost gap being resistor free, any residual current flow after arc extinction may be interrupted and thereby there is no need for the previously described disconnector.

It should here be realized that it is possible to vary the second embodiment in several ways. The non-bridged air gap may be different than the resistor-bridged air gaps. The top or uppermost gap may thus be different than the other gaps between neighboring plates (between the parallel splitter plates and base plate) below it. It may for instance be wider or narrower. Thereby the air gaps between neighboring splitter plates of an arc chute except for the air gap between the uppermost splitter plate and its neighbor SP3A may have the same widths.

It is also possible that the uppermost splitter plate has a different shape or size than the rest of the splitter plates. The size of the uppermost splitter plate may thus be different than the sizes of at least some of the other splitter plates in an arc chute. Moreover, the distance of the top gap and the size of the top splitter plates may be adjustable, which means that the top gap can be adjusted to be larger or smaller than the rest of the gaps between the splitter plates and between the lowermost splitter plate and the base plate. It is also possible to omit the two electrical connections 24 and 26 so that the uppermost splitter plates SP4A and SP4B are also galvanically isolated from the contact bridging element 22. In a similar manner it is possible to add the two electrical connections in the first embodiment.

Figure 4:
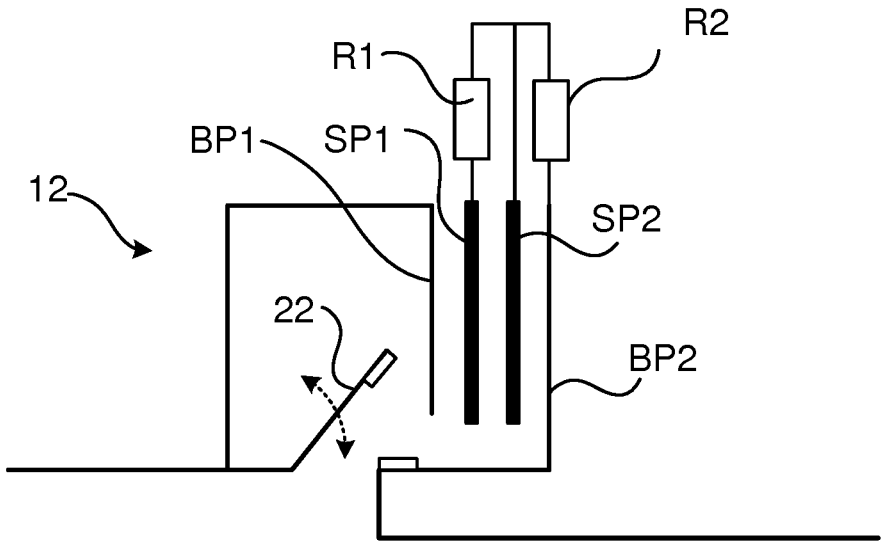

FIG. 4 shows another embodiment of the circuit bridging section only comprising a single arc chute.

The arc chute comprises two splitter plates SP1 and SP2 between a first and a second base plate BP1 and BP2, which plates extend vertically out from a contact bridging element 22, which in this embodiment is moveable, i.e. pivotable, around a rotational axis. In this embodiment all the plates BP1, SP1, SP2 and BP2 are separated from each other via equally sized air gaps. In this embodiment the first splitter plate SP1 is connected to the second splitter plate SP2 via a first resistor R1 and the second splitter plate SP2 is connected to the second base plate BP2 with a second resistor R2.

It is possible to vary also this embodiment. It is for instance possible to change the splitter plate orientation so that it is aligned with the movement of the moveable bridging element also for this type of circuit breaking section. This may be done through placing the base plates and splitter plates radially along the direction of movement of the moveable bridging element.

Figure 5:
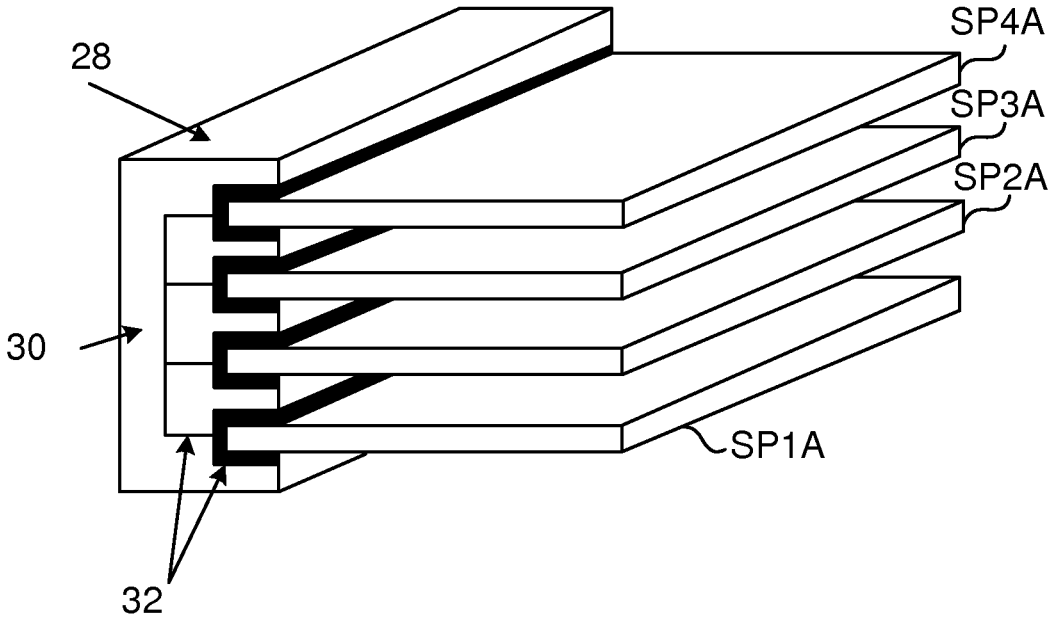
FIG. 5 shows a perspective view of one way of realizing the first arc chute that can be used in both the first and second embodiments of the circuit breaking section.

In order to obtain a more compact arc chute structure, the resistors of the arc chute may be provided as a part of a holding structure used for holding the splitter plates. One example of such a structure with splitter plates that can be used for both the first and second arc chutes of the first and second embodiments is shown in a perspective view in FIG. 5. In this example there is a bar shaped holding structure 28 with rectangular cross-section. The holding structure 28 also comprises recesses into which edges of the splitter plates may be inserted for being held. There are in FIG. 5 four recesses stretching along the length of the holding structure 28 for holding one edge of corresponding splitter plate SP1A, SP2A, SP3A and SP4A. The holding structure 28 is more particularly made of a polymer, the majority of which is non-conducting 30. However, the recesses in the holding structure as well as traces that interconnect these recesses are formed using conductive polymer, where at least the traces form the resistors. The resistors are in this case thus realized using conductive polymer traces 32 between the splitter plates SP4A, SP3A, SP2A, SP1A in the holding structure. Thereby the resistors that bridge the air gaps are realized using traces of conductive polymer in the holding structure. In this way there is also provided a compact structure. This type of structure is only possible to use for high-ohmic resistors.

The holding structure 28 may furthermore be a part of the side wall in a chamber where the arc chutes are being placed. Thereby the resistors might be combined with the sidewalls using extruded semiconducting polymers.

Another way is to integrate a circuit board in the wall of the arc chute on the outside and thereby protect it against hot gas.

In the examples given above, the second arc chute had the same realization as the first arc chute. It should however be realized that this is not necessarily the case. The second arc chute may in the previously described embodiments for instance be realized without resistors.

As was mentioned earlier, the switchgear may be used in both AC and DC applications. In the case of AC applications the moveable contact bridging element is opened in order to create an arc between the base plates and this arc will get extinguished when there is a zero crossing in the current, which occurs naturally for AC systems.

However, in DC systems, when the switchgear is a DC switchgear, there are no such naturally occurring zero crossings in the current. Another aspect of the invention is concerned with the injection of opposing currents into the switchgear for obtaining current zero crossings.

The purpose of the current injecting section 14 is to cause a zero crossing in the arc of a current running through the circuit breaker section that is to be interrupted. The purpose is thus to obtain such a current zero crossing enabling the extinguishing of an arc occurring when the contact bridging element is opened.

Figure 6:
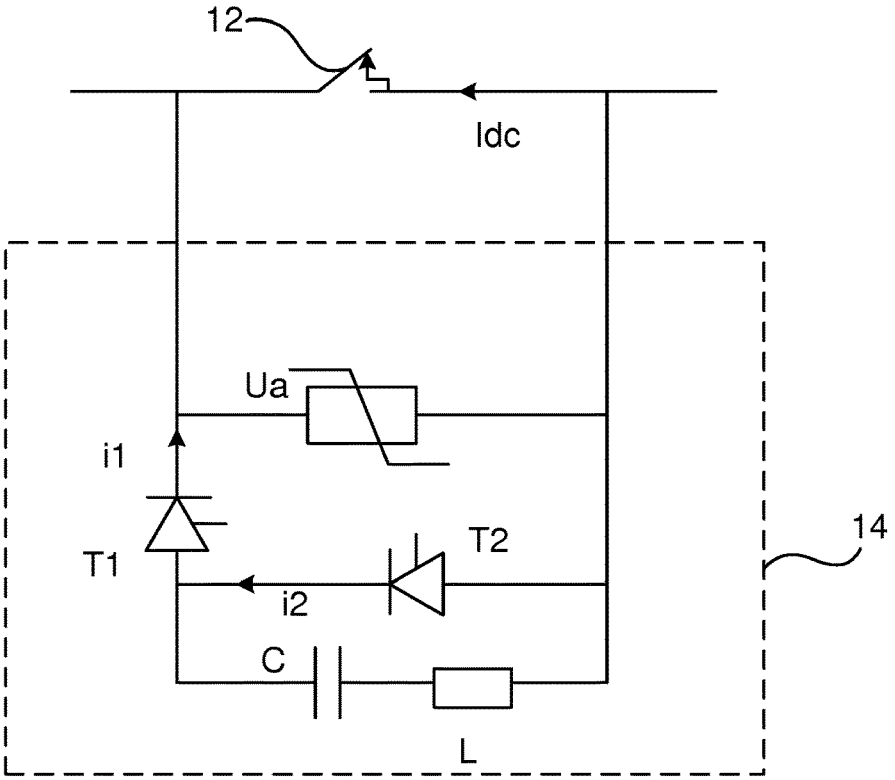
FIG. 6 shows a first realization of the current injecting section.

A first example of the current injecting section 14 implementing such a circuit connected in parallel with the circuit breaking section 12 is shown in FIG. 6. A current injecting section thus comprises a surge arrester Ua connected in parallel with the circuit breaking section 12. A first thyristor T1 is connected between a first end of the surge arrester Ua and a first end of a parallel circuit, which parallel circuit comprises a second thyristor T2 in parallel with a branch comprising a capacitor C in series with an inductor L. The second end of the parallel circuit is in turn connected to a second end of the surge arrester Ua. The direction of conductivity of the first thyristor T1 is towards the surge arrester Ua and the direction of conductivity of the second thyristor T2 is towards the first thyristor T1.

The operation of the above-described current injection section 14 is the following. Once an arc voltage between the contact bridging element and the base plates of the circuit breaking section 12 is detected, thyristor T1 is fired after an appropriate time delay. Then the resonant capacitor C is charged by the arc voltage and an injection current of opposite direction flows through the switchgear. T1 will be switched off automatically once the injection current I1 is equal to zero. The voltage of resonant capacitor C may be roughly two times of arc voltage. Then there will be a time delay which is larger than the turn-off time of thyristor T1. Hereafter, thyristor T2 is fired to let the resonant capacitor C discharge. The capacitor C changes polarity at the end of this discharge period and the voltage amplitude of capacitor C is retained. After another time delay (larger than turn off time of thyristor T2), the thyristor T1 is fired once again. This time the voltage differential between C and arc is roughly triple of the arc voltage. Consequently injection current I1 dramatically increases as well. By repeating this process (firing T1 then T2), a series of resonant injection current I1 is super-imposed to the load current Idc running through the circuit breaking section 12. When the injection current reaches the same amplitude as the load current, then total current inside the switchgear drops to zero and the arc is interrupted successfully. The load current turns to charge the resonant capacitor C, the voltage across contacts rises up until it reaches a protective voltage level of surge arrester Ua, then the load current commutates to the surge arrester Ua and reaches zero after a while.

The arc might re-ignite in the case that the transient recovery voltage between contacts is larger than the gap withstand voltage. Then thyristor T2 should be fired again to discharge the resonant capacitor C. This process (firing T1 then T2) continues until the load current is finally interrupted.

The circuit in FIG. 6 operates for unidirectional load currents. It is possible to make the circuit handle bidirectional load currents by connecting additional thyristors in anti-parallel with the first and second thyristors T1 and T2. Moreover, it is also possible to connect an additional anti-parallel thyristor pair in series with the pair of first thyristor T1 with anti-parallel further thyristor.

Figure 7:
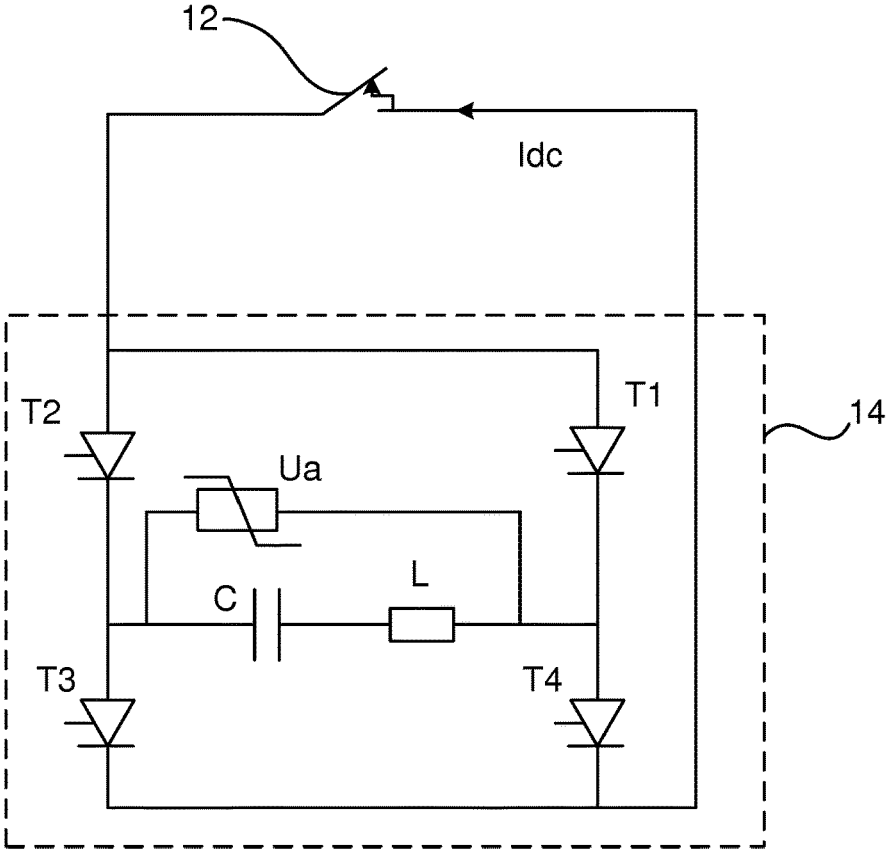
FIG. 7 shows a second realization of the current injecting section.

There are a number of possible further variations of the circuit in FIG. 6, where one is shown in FIG. 7.

In FIG. 7 there is a parallel circuit comprising a surge arrester Ua connected in parallel with a branch comprising the capacitor C connected in series with the inductor L. Moreover, the second thyristor T2 is in this case connected between a first end of the circuit breaking section 12 and a first end of the parallel circuit, while the first thyristor T1 is connected between the same first end of the circuit breaking section 12 and a second end of the parallel circuit. Moreover a third thyristor T3 is connected between the first end of the parallel circuit and the second end of the circuit breaking section 12, while a fourth thyristor T4 is connected between the second end of the parallel circuit and the second end of the circuit breaking section 12. In FIG. 7 the second thyristor T2 has a direction of conductivity towards the first end of the parallel circuit while the first thyristor T1 has a direction of conductivity towards the second end of the parallel circuit. The directions of conductivity of the third and fourth thyristors T3 and T4 are both towards the second end of the circuit breaking section 12.

When operating the current injecting section 14, first thyristors T1 and T3 are fired to charge the resonant capacitor C. Then thyristors T2 and T4 are fired to discharge the resonant capacitor C, both charging and discharging current flow though the contact bridging element of the circuit breaking element, therefore the total current zero crossing is reached faster and even if arc re-ignition occurs, a new current zero crossing is reached faster as well.

Figure 8:
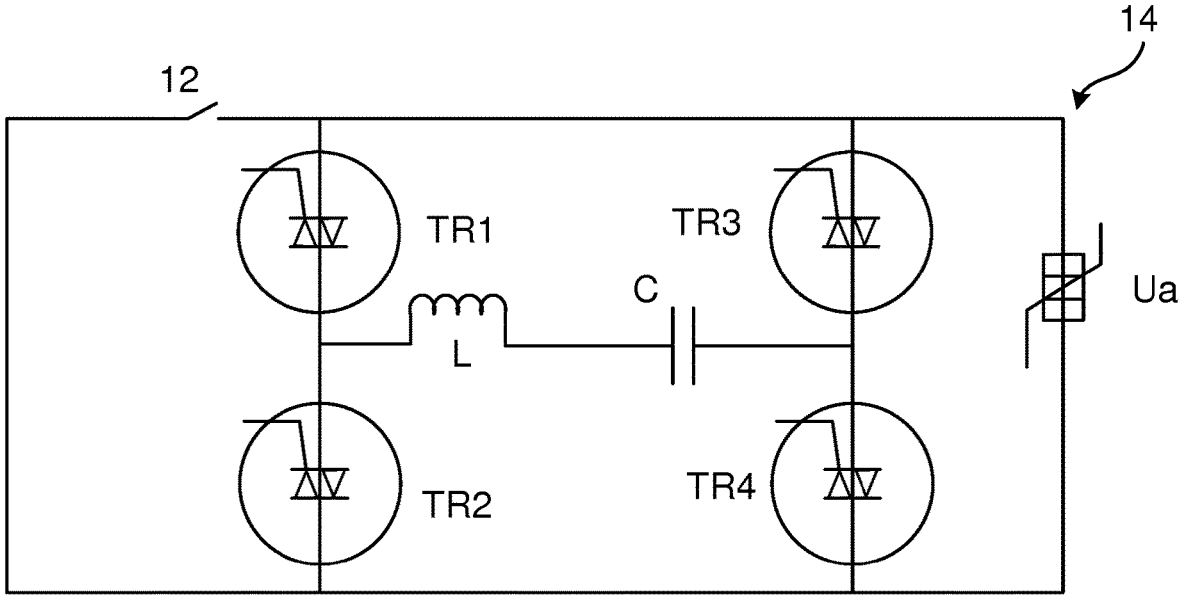
FIG. 8 shows a third realization of the current injecting section.

Another alternative solution is shown in FIG. 8. In this case there is a series-circuit of inductor L and capacitor C, where a first thyristor unit or first triac TR1 is connected between a first end of the series-circuit and the second end of the circuit breaking section 12 and a second thyristor unit or second triac TR2 is connected between the first end of the series-circuit and a first end of the circuit-breaking section 12. There is also a third thyristor unit or third triac TR3 connected between a second end of the series-circuit and the second end of the circuit breaking section 12 and a fourth thyristor unit or fourth triac TR2 connected between the second end of the series-circuit and the first end of the circuit-breaking section 12. The surge arrester Ua is finally connected between the first and second ends of the circuit breaking section 12.

The current injection section 14 of FIG. 8 is also a bi-directional circuit with fast current interruption, as all current pulses through the resonant circuit are current injections. It is much faster in reaching the total current zero crossing than the previously mentioned circuits. However, this alternative circuit doubles the number of thyristors, since each thyristor unit comprises a triac or two anti-parallel thyristors.

Above were given a few examples of resonance circuits used for injecting currents that achieve current zero crossings. It should be realized that these are merely a few examples of circuits that may be used for introducing current zero crossings.

From the foregoing discussion it is evident that the present invention can be varied in a multitude of ways.

It shall consequently be realized that the present invention is only to be limited by the following claims.

The invention claimed is:

1. A switchgear comprising a circuit breaking section having a movable contact bridging element and a first arc chute adjacent to the contact bridging element, said first arc chute including a base plate for connecting to the contact bridging element and a group of splitter plates placed adjacent to the base plate, wherein the splitter plates are separated from the base plate and each other via air gaps, wherein all the splitter plates in the first arc chute except for an uppermost splitter plate are interconnected by resistors for bypassing corresponding air gaps, wherein said resistors have values in a range 5 kΩ-1 MΩ, current ratings below 100 mA and power ratings below 1 W.

2. The switchgear according to claim 1, wherein the movable contact bridging element is electrically connected to the uppermost splitter plate of the first arc chute.

3. The switchgear according to claim 2, wherein a size of the uppermost splitter plate in the first arc chute is different than sizes of other splitter plates in the first arc chute.

4. The switchgear according to claim 2, wherein the air gaps between the splitter plates of the first arc chute, except for the air gap between the uppermost splitter plate and the splitter plate adjacent to the uppermost splitter plate, have equal widths.

5. The switchgear according to claim 2, wherein all of the air gaps in the first arc chute have equal widths.

6. The switchgear according to claim 2, wherein the splitter plates of the first arc chute are held by a polymer holding structure.

7. The switchgear according to claim 2, further comprising a second arc chute, where the first and second arc chutes are provided on opposite sides of the contact bridging element.

8. The switchgear according to claim 2, wherein the switchgear is a direct current switchgear and further includes a current injecting section configured to cause a zero crossing in a current through the circuit breaker section that is to be interrupted.

9. The switchgear according to claim 1, wherein a size of the uppermost splitter plate in the first arc chute is different than sizes of other splitter plates in the first arc chute.

10. The switchgear according to claim 1, wherein the air gaps between the splitter plates of the first arc chute, except for the air gap between the uppermost splitter plate and the splitter plate adjacent to the uppermost splitter plate, have equal widths.

11. The switchgear according to claim 1, wherein all of the air gaps in the first arc chute have equal widths.

12. The switchgear according to claim 1, wherein the splitter plates of the first arc chute are held by a polymer holding structure.

13. The switchgear according to claim 12, wherein the resistors are conductive polymer traces between splitter plates in the holding structure.

14. The switchgear according to claim 1, further comprising a second arc chute, where the first and second arc chutes are provided on opposite sides of the contact bridging element.

15. The switchgear according to claim 14, wherein the second arc chute has a base plate for connecting to the contact bridging element and a group of splitter plates placed adjacent to the base plate, wherein the splitter plates of the second arc chute are separated from the base plate of the second arc chute and each other via air gaps.

16. The switchgear according to claim 15, wherein the base plates of the first and second arc chutes are provided in a common plane, wherein the movable contact bridging element is movable along a first axis perpendicular to a plane of the base plates, and wherein for each of the first and second arc chutes, the respective splitter plates are separated from each other along a direction in parallel with the first axis.

17. The switchgear according to claim 15, wherein all the splitter plates in the second arc chute except for an uppermost splitter plate are interconnected by resistors; and wherein the base plates of the first and second arc chutes are provided in a common plane, wherein the movable contact bridging element is movable along a first axis perpendicular to a plane of the base plates, and wherein for each of the first and second arc chutes, the respective splitter plates are separated from each other along a direction in parallel with the first axis.

18. The switchgear according to claim 1, wherein the switchgear is a direct current switchgear and further includes a current injecting section configured to cause a zero crossing in a current through the circuit breaker section that is to be interrupted.

* * * * *